US006502631B1

(12) United States Patent
Fitzgibbon

(10) Patent No.: US 6,502,631 B1
(45) Date of Patent: Jan. 7, 2003

(54) REINFORCED BOREHOLE PLUGS

(76) Inventor: Daniel F. Fitzgibbon, P.O. Box 545, Simpsonville, KY (US) 40067

( * ) Notice: Subject to any disclaimer, the term of this patent is extended or adjusted under 35 U.S.C. 154(b) by 37 days.

(21) Appl. No.: 09/873,064

(22) Filed: Jun. 4, 2001

(51) Int. Cl.[7] ..... E21B 33/127

(52) U.S. Cl. ..... 166/63; 166/187; 175/4.52; 86/20.15; 102/304; 102/313; 102/333

(58) Field of Search ..... 166/63, 187; 175/4.52; 86/20.15; 102/304, 319, 323, 333

(56) References Cited

U.S. PATENT DOCUMENTS 4,846,278 A * 7/1989 Robbins
4,913,233 A * 4/1990 Fitzgibbon
4,919,203 A * 4/1990 Fitzgibbon
5,000,261 A * 3/1991 Fitzgibbon
5,035,286 A * 7/1991 Fitzgibbon
5,273,110 A * 12/1993 Fitzgibbon
5,936,187 A * 8/1999 Miller et al.

* cited by examiner

*Primary Examiner*—Roger Schoeppel
(74) *Attorney, Agent, or Firm*—Kenneth E. Darnell

(57) ABSTRACT

Reinforced borehole plugs useful in the presplitting and blast removal of earth formations, the improvements provided by the invention comprising inflatable devices intended to support stemming, explosives and the like at suspended locations within a borehole to produce desired blast results. The borehole plugs of the invention comprise inflatable sport balls such as are used on playgrounds as toys and which are reinforced according to the invention to maintain inflation within a borehole, a characteristic which playground balls can only inconsistently provide. The borehole plugs of the invention are preferably inflatable through use of valve structures which permit pumping of an inflating fluid into the plugs once the plugs are respectively suspended at desired locations within boreholes prior to filling the boreholes in whole or in part with stemming and/or explosives and the like.

11 Claims, 3 Drawing Sheets

REINFORCED BOREHOLE PLUGS

BACKGROUND OF THE INVENTION

1. Field of the Invention

The invention relates generally to relatively inexpensive borehole plugs formed from toy or sport balls typically used for play such as by children and/or in sporting events, the borehole plugs particularly being used to support stemming and/or explosives within a borehole to facilitate shattering of earth formations by detonation of explosives within one or more boreholes.

2. Description of the Prior Art

Mining and earth removal operations often employ methodology known in the art as presplitting, this practice involving the shattering of earth formations in a controllable manner to facilitate the removal of overburden to expose seams of material which are to be mined. Devices have previously been available in the art to "plug" boreholes drilled in patterns for the practice of presplitting. Such devices have been intended to suspend explosives and/or stemming within such boreholes. Devices have also been available in the art for suspending stemming and/or explosives within boreholes intended to facilitate production blasting by various methods common in the art. A discussion of the prior art can be found in U.S. Pat. No. 5,035,286 to Fitzgibbon, Jr. relative to prior art previously available in the mining and earth removal industries. This patent also comprises prior art relative to the present invention. Further, the disclosure of U.S. Pat. No. 5,035,286 is incorporated hereinto by reference. Further, the disclosures of U.S. Pat. Nos. 4,913,233; 4,919,203; 5,000,261 and 5,273,110 are also incorporated hereinto by reference, these patents having the same inventor as the present patent application and common ownership with the present patent application.

Also incorporated hereinto by reference is U.S. Pat. No. 3,357,193, also to Fitzgibbon, Jr., which patent discloses temporary closure devices for boreholes, the devices being formed as inflatable, tubular structures which are inserted in a deflated condition into the upper end of a borehole and inflated therein in order to temporarily close off the hole to prevent ingress of water, to prevent ice formation within the hole and to prevent blockage of the hole by undesirable material which can fall into an open borehole. The devices of this patent further act to prevent personnel from stepping into or falling into such holes with resulting injury.

On recognition of the value of the technology disclosed in the aforesaid patents, the industry has attempted to identify inexpensive alternatives to the particular inflatable devices described in the aforesaid patents, the devices of the patents being formed of materials and through the use of methodology which has resulted in inflatable borehole plugs of exceptional reliability. The borehole plugs provided according to the aforesaid patents were found to be rapidly and conveniently useable in field blasting operations, the said borehole plugs being repositionable as desired within a borehole in the event that initial positioning within the borehole was not satisfactorily accomplished or the initial position was not the most desirable location for the plug. While the borehole plugs configured according to the aforesaid patents are relatively inexpensive in view of their value in the shattering of earth formations, practitioners in the art have continually attempted to form such borehole plugs from exceedingly cheap materials, such as the "rubbers" used to manufacture ordinary playground balls or the like. While certain of these inflatable playground balls have functioned within certain environments at least a certain percentage of the time, these insubstantial devices have not proven to be satisfactory due to the large percentage of these devices which lose pressure once inflated within a borehole and thus have to be replaced if the user is fortunate enough to have avoided placement of stemming or explosives on top of such devices. Failure of these prior devices to maintain pressure once stemming or explosives or the like have been deposited within a borehole results in loss of the borehole and any value of the explosives and/or stemming or the like in subsequent blasting operations. The present invention particularly intends the fabrication of borehole plugs formed of plug wall materials of lesser quality than has previously been permissible with necessary reliability, the borehole plugs according to the invention being improved through reinforcement which permits the present plugs to function properly and with desired reliability within the harsh confines of a borehole wherein walls of the borehole contain irregular and jagged rock and earth surfaces and projections from said surfaces. The present devices thus constitute a significant and substantial advance in the art.

SUMMARY OF THE INVENTION

The inflatable devices of the invention suspend explosives and/or stemming materials within boreholes formed in earth formations to allow practice of methods for shattering the earth formations to effect presplitting or earth removal inter alia. The inflatable devices of the invention are positioned within boreholes in a deflated condition and are inflated at the desired locations within the hole to seal or "plug" the hole for support of explosive columns and/or stemming columns. The inflatable devices are formed according to the invention of common toy or sport balls of differing diameter and which are further provided with a reinforcing scrim disposed over inner wall surfaces thereof, the structure being completed by provision of an inner elastomeric layer which acts along with the toy or sport ball outer layer to sandwich the scrim therebetween the thus reinforce the inflatable device so formed. Use of the toy or sport ball itself without further improvement according to the invention results in production of an inflatable device essentially formed of a "rubber" material or other elastomeric material which is extraordinarily susceptible to deflation within the environment of a borehole, it being necessary for an adequate inflatable device to support columns of explosives and/or stemming which can weigh many tons. Even though the toy or sport ball itself may be thicker than the materials used to form the inflatable devices particularly described in U.S. Pat. No. 5,035,286, for example, these toy or sport balls are not adequate to the intended use since said balls do not have the capability to stretch to a degree sufficient to cause the inflatable device so formed to be firm within the borehole and yet resist continued stretching, particularly in directions along the longitudinal axis of the borehole which causes an unacceptable number of such devices to fail.

While inflatable devices configured according to the invention can be formed with gas or foam generating materials sealed within said inflatable devices, it is preferred to form the inflatable devices of the invention with valves which allow inflation of the devices through hoses connected to the valves while the devices are in place within the boreholes. Valves such as tire valves, oral valves, needle valves and the like are useful. However, it is to be noted that valves such as needle valves are self-sealing and are readily connected to and disconnected from an air line such that the device can be lowered down into a borehole, inflated and then readily released from the air line. The use of certain types of valves, such as oral valves, typically require a protective flap when used with the devices of the invention.

The devices of the invention can be formed in differing sizes to accommodate boreholes of differing diameter. When used for presplitting with holes of relatively smaller diameter, columns of explosives or stemming are of lesser total weight than is the case with presplitting and production boreholes of diameters of nine inches or greater where explosive or stemming columns can weigh substantially more.

The scrim employed for reinforcement of the present inflatable devices is preferably chosen to be a nonwoven material formed of filamentary elements having high tensile strength, that is, the greatest strength of the filamentary elements are along the longitudinal axis of the filamentary material. It can thus be said that the filamentary material is anisotropic. While a single "filament" could theoretically be used to form a reinforcing scrim for a single inflatable device according to the invention, it is to be realized that in practice a multiplicity of such filaments would be laid down in a random pattern in order to form the reinforcing scrim. Nonwoven scrim such as described is of particular utility due to cost and due to realization of the advantages of the anisotropic character of the filamentary material itself. Forces transmitted through the exterior wall of the inflatable device of the invention are directed along the length of the filaments and are thus accommodated by the high tensile strength of the filaments. The inner elastomeric layer of an inflatable device configured according to the invention acts to hold the reinforcing scrim adjacent to the outer covering, that is, the playground ball portion, of the device.

It is to be understood that the present inflatable devices can be provided with reinforcement of other description including woven materials formed of filaments having high anisotropic characteristics, anisotropic whisker materials and even patterns of filamentary materials regularly laid down at given angles including right angles to each other and having spacings therebetween, these patterns of substantially anisotropic material being held adjacent the outer covering of the inflatable device by means of the inner layer of rubberized or elastomeric material. The reinforcing structure is thus held in a "sandwich" fashion between outer and inner layers which are stretchable due to the rubberized nature or elastomeric nature of the materials from which formed.

The weight of certain of the plugs configured according to the invention can cause an inflation needle normally inserted into a valve of the plug to pull loose from the valve during lowering of the plug into a borehole. As is usual in the art, a plug is suspended on the free end of an inflation hose through the agency of an inflation needle received into the valve formed in the inflatable plug, the needle being connected to the free end of the inflation hose. In order to prevent pulling out of the inflation needle from the valve which can occur in hot climates, in particular, a friction adapter preferably formed of rubber or the like is used to prevent slippage of the plug and is connected to the plug at least during lowering of the plug into a borehole and positioning of the plug within the borehole. The adapter is essentially a rubber grommet with one end adhered to the plug above the inflation valve. The adapter has a central channel through which the inflating needle and a portion of the inflation hose extend to allow the needle to be received into the inflation valve. A U-shaped bracket attached to the end of the inflation hose at one end of the bracket attaches removable to the grommet at the other end of the bracket. The bight portion of the adapter is of a length chosen to separate the two ends of the bracket from each other according to the length of the inflation needle chosen for use. Once the plug is located within the borehole and inflated, the needle, hose and bracket can be disconnected from the grommet and thus the plug and recovered by executing a sharp jerking motion on the opposite end of the hose.

Accordingly, it is a primary object of the present invention to provide inflatable devices useful in presplitting and production blasting of earth formations, these devices exhibiting characteristics enabling a use within the environment of a borehole to suspend substantial quantities of stemming and/or explosives without deflation and with economy of material and fabrication.

It is another object of the present invention to provide inflatable devices useful in presplitting and production blasting of earth formations and having an outer covering substantially taking the form of a playground or sport ball manufactured of a rubberized or elastomeric material, the ball being reinforced internally thereof to enable its reliable use in presplitting and blasting of earth formations.

It is a further object of the invention to provide inflatable devices useful in the presplitting and production blasting of earth formations by suspension of the inflatable devices in boreholes to support stemming and/or explosives within said boreholes, the inflatable devices particularly being formed of rubberized or elastomeric toy or playground balls having a scrim reinforcement disposed internally of the ball and adjacent inner wall surfaces of said ball and held against said inner surfaces by means of an interior layer of rubberized or elastomeric material, the scrim being formed of an anisotropic material having high tensile strength.

It is another object of the invention to provide an adapter arrangement which can be joined to the plug at a location thereof surmounting a needle insertion aperture of a valve formed in the plug, the adapter arrangement providing sufficiently positive connection of the inflation needle to the plug as to allow lowering of the plug into a borehole and positioning of the plug without concern that the weight of the plug will cause the plug to slip from the needle.

Still further objects and advantages of the invention will become more readily apparent in light of the following detailed description of the preferred embodiments.

DESCRIPTION OF THE PREFERRED EMBODIMENTS

Figure 1:
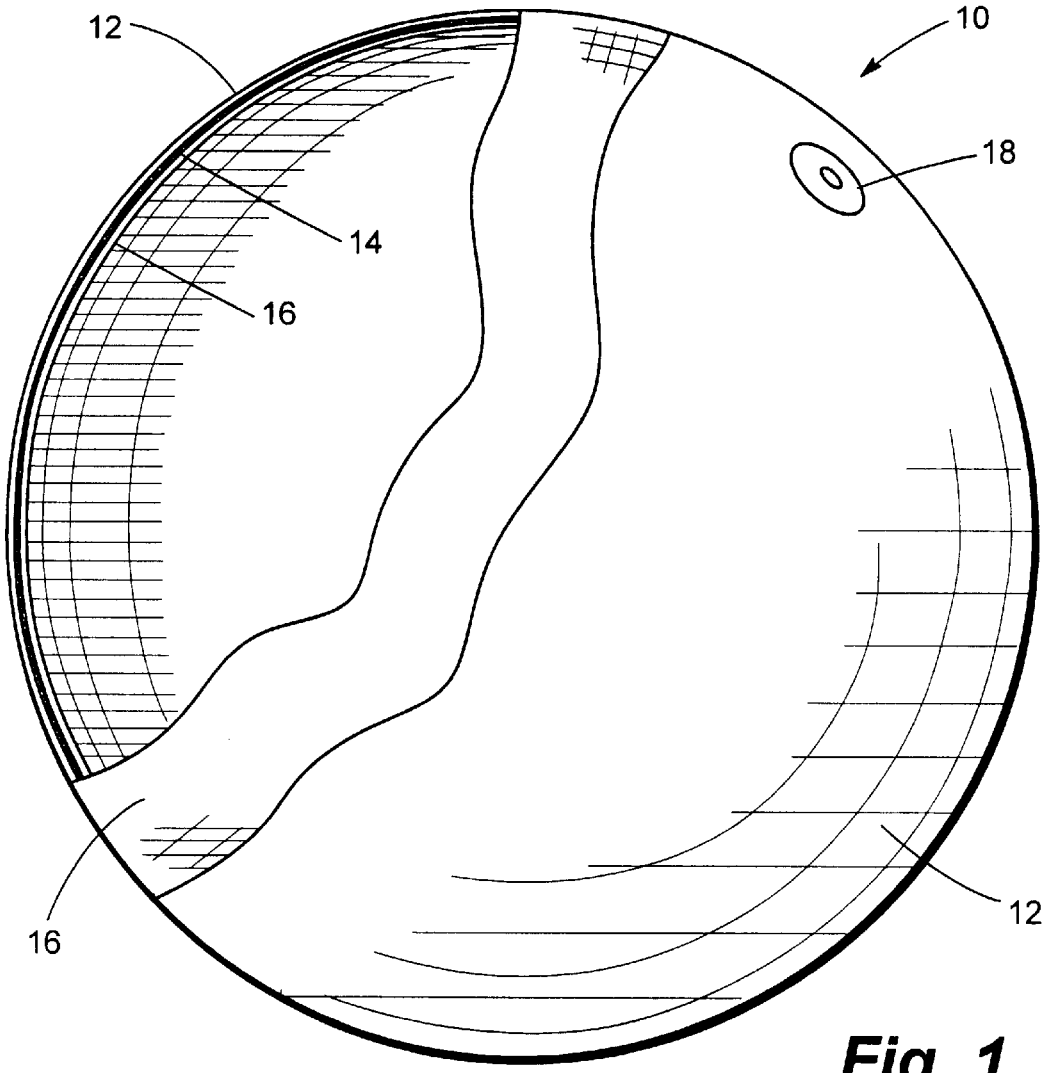
FIG. 1 is a perspective view of an inflatable device configured according to the invention with a portion cut away to better illustrate the structure of the invention.

Referring now to the drawings, and particularly to FIG. 1, a preferred inflatable device configured according to the invention is seen at 10 to provide an outer covering 12 formed of a material which is resilient or "stretchable". The outer covering 12 preferably takes the form of a conventional toy ball, playground ball, or sport ball formed of a natural rubber formulation or synthetic elastomeric formulation as is conventional in the art. The outer covering 12 is of a thickness and material formulation such as is conventional in the art of playground balls and the like. Although inflatable devices formed only of the outer covering 12 have previously been used as substitutes for the inflatable devices of the patents incorporated hereinto by reference, it is known that such devices formed solely of playground balls do not provide the reliability of function required in the mining and earth blasting arts. Such playground balls have a tendency to deflate when disposed in a borehole supporting large masses of stemming and/or explosives especially when the playground ball has been caused to abnormally stretch when filled with fluid pressures of a magnitude necessary to use in mining and earth removal operations.

The inflatable device 10 of the invention, however, is improved by provision of a reinforcing scrim 14 which is sandwiched between the outer covering 12 and inner body 16 which essentially takes the form of a stretchable, inflatable bladder formed essentially congruently with the outer covering 12. It is to be appreciated that the outer covering 12 and the inner body 16 are both formed of resilient or "stretchable" material. It is further to be appreciated that the inner body 16 is actually inflated through valve 18 for those embodiments of the invention which are not inflated by means of an inflation source disposed interiorly of the inner body 16 and self-contained therewithin. The inner body 16 further acts to maintain the reinforcing scrim 14 adjacent to and in contact with inner wall surfaces of the outer covering 12, it being imperative that the reinforcing scrim 14 be disposed adjacent to and contiguous to the outer covering 12 such that forces acting on the inflatable device 10 and particularly on the outer covering 12 are transferred to the reinforcing scrim 14, thereby to allow the inflatable device 10 to be inflated to much higher pressures than would be possible if using the outer covering 12 alone.

Figure 3:
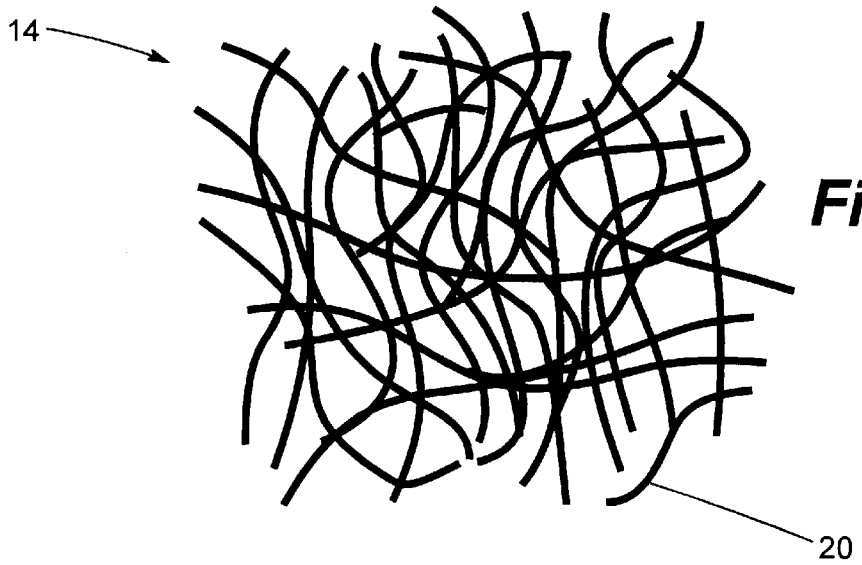
FIG. 3 is an idealized view of a reinforcing scrim configured according to the invention and having a random and unwoven nature.

The reinforcing scrim 14 can take a variety of configurations including the non-woven, random pattern seen in FIG. 3, the scrim 14 of FIG. 3 being formed of filamentary material 20 having high tensile strength and which exhibits anisotropic character in that the strength of the filamentary material 20 along the longitudinal axis thereof is substantially greater than strength axially of said material. While the filamentary material 20 could be a single exceptionally long strand of material, in practice it is preferred to form the scrim 14 from a number of filaments or strands. The filamentary material 20 can take the form of thread-like filaments, and anisotropic whisker materials which have cross-sections of differing configuration including polygonal, circular or nearly so and even strap-like or strip-like materials as long as the material 20 accommodates forces along its length The filamentary material 20 need not be bonded into a pattern by an adhesive or the like. Further, the scrim 14 need not be bonded to inner wall surfaces of the outer covering 12 or outer wall surfaces of the inner body 16. Performance is maximized when the reinforcing scrim 14 is provided with the ability to be displaced if only slightly relative to inner wall surfaces of the outer covering 12 and outer wall surfaces of the inner body 16.

Figure 4:
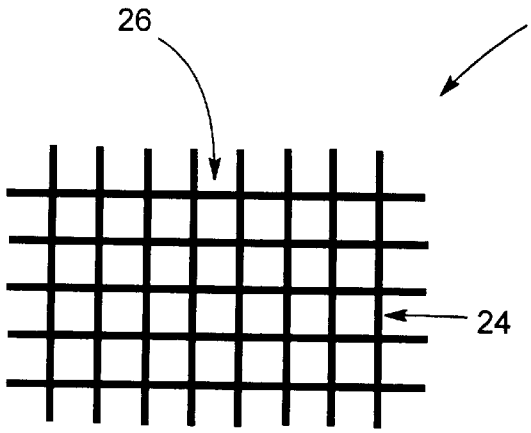
FIG. 4 is an idealized view of a nonwoven reinforcing structure wherein filamentary elements are configured to lie at regular angles and spacings relative to each other.

A nonwoven scrim 22 is seen in FIG. 4 to be formed of filamentary elements 24 and 26 which are arranged at regular angles and regular spacings relative to each other in a pattern which is nonwoven The pattern such as is seen in FIG. 4 can be varied substantially to include differing angles and differing spaces.

Figure 5:
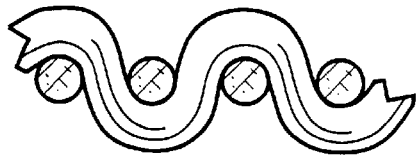
FIG. 5 is an idealized view of a reinforcing structure configured according to the invention and being formed of woven filamentary elements having high tensile strength.

As is seen in FIG. 5, a scrim 28 is seen to be formed of woven material. The scrim 22 and 28 of FIGS. 4 and 5 can also take the differing forms of filamentary materials including cross-sections and the like such as has been described hereinabove relative to the scrim 14. The filamentary materials can be formed of synthetic polymeric materials such as polyesters for ease of manufacture and for reduced expense. The filamentary materials per se preferably exhibit little or no stretchability although the various scrims of the invention can be formed of filamentary materials having at least some resiliency or stretchability along longitudinal axes thereof.

Figure 2:
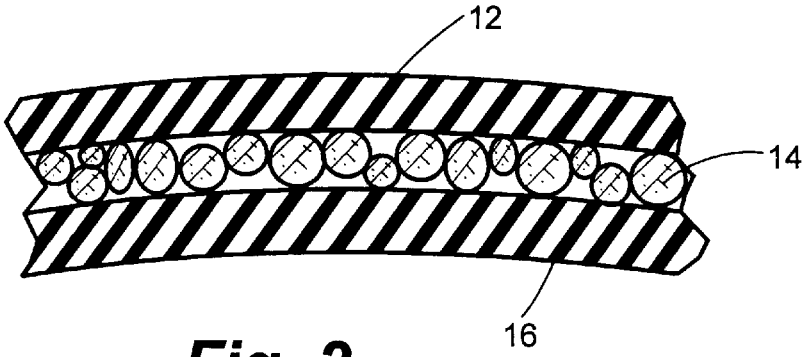
FIG. 2 is a detail cross-section taken through a wall of the device of FIG. 1.
Figure 6:
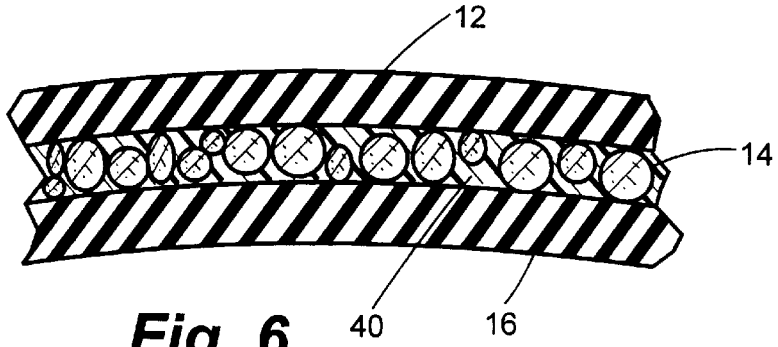
FIG. 6 is a detailed cross-section of a wall of an inflatable device having a reinforcing scrim potted between inner and outer walls of the device.

Referring to FIGS. 2 and 6 in particular, it is to be seen that the scrim 14 of FIG. 2 is disposed between the outer covering 12 and the inner body 16 without being adhered to either the covering 12 or the body 16. In FIG. 6, a potting material 40 such as an adhesive or the like is disposed within spaces between the outer covering 12 and the inner body 16 such that the scrim 14 is bonded in place relative to either of the covering 12, the inner body 16 or both.

Figure 7:
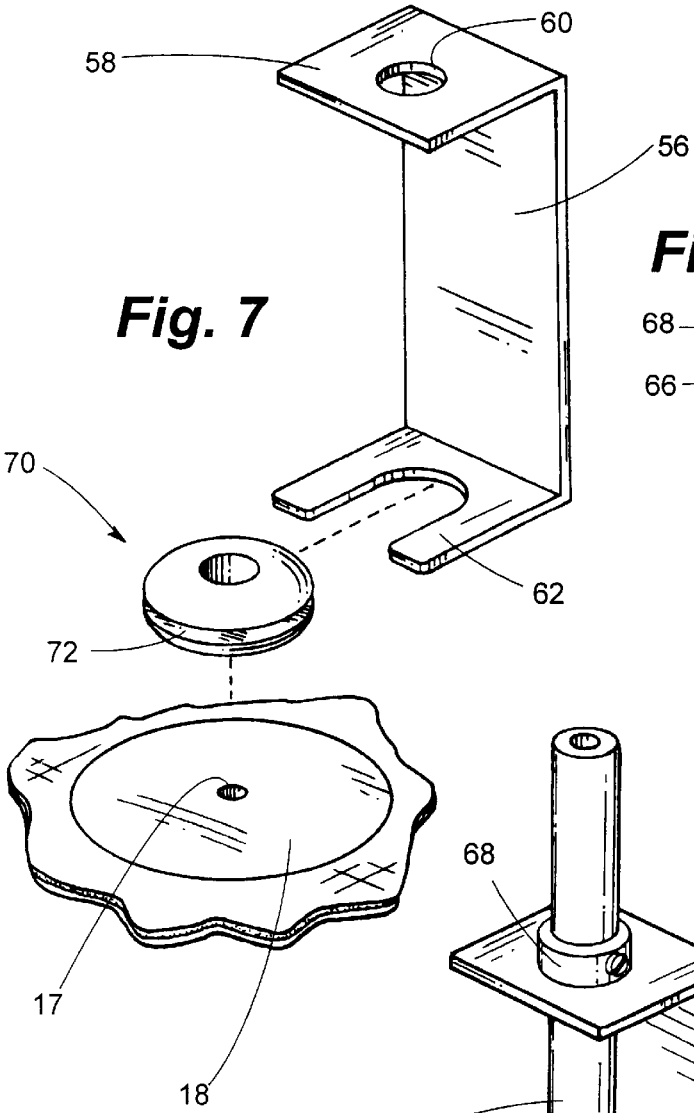
FIG. 7 is a perspective exploded view of an adapter arrangement having a grommet attachable to an inflatable device and a bracket mounted to a distal end of an inflating hose to prevent the inflatable device from slipping off of the needle.
Figure 8:
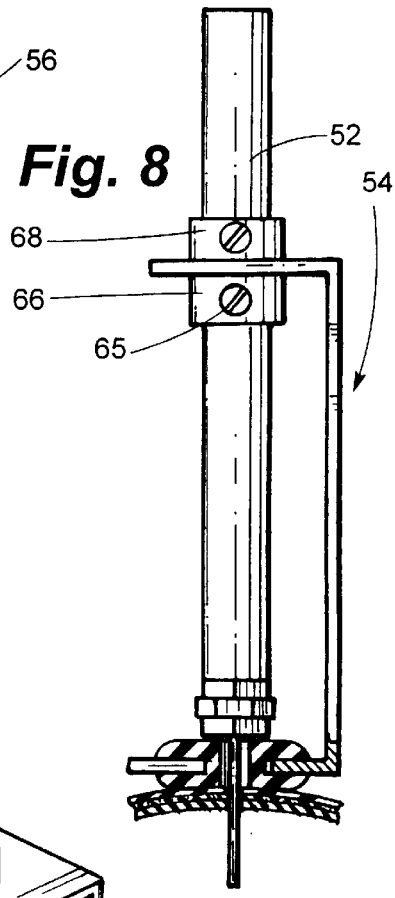
FIG. 8 is a side elevation view of the adapter arrangement illustrating a grommet and bracket which cooperate to maintain the needle and hose in connection with the inflatable device after the needle is inserted into the needle insertion aperture of the valve of the inflatable device; and, FIG. 9 is a perspective view of the bracket attached to the distal end of the inflation hose.
Figure 9:
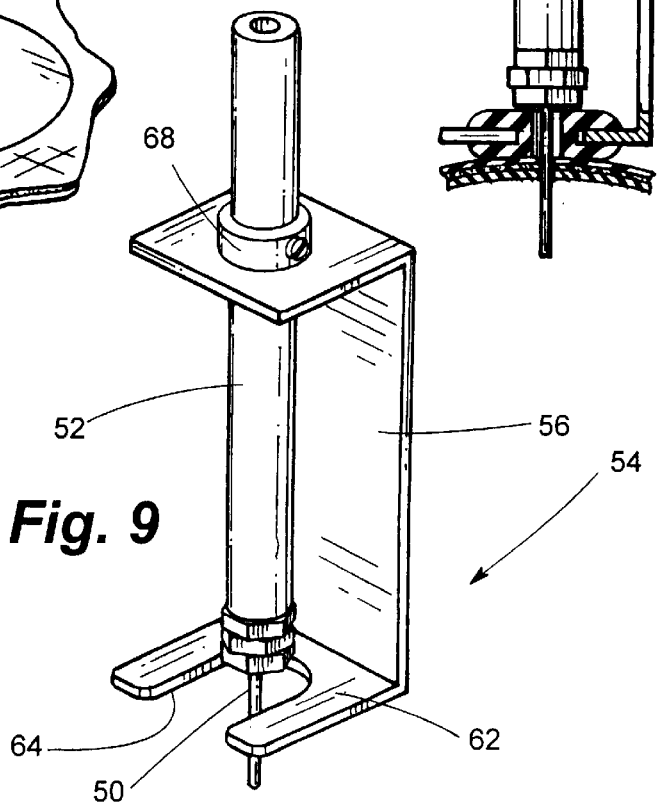

Referring now to FIGS. 7 through 9, an adapter arrangement is seen to be comprised of a rubber grommet 70 which can be adhered to an inflatable device in surmounting relation to the insertion aperture 17, an annulus 72 of the grommet receiving legs 64 of a U-shaped bracket 54, the legs 64 being defined by a U-shaped notch formed in plate 62 which forms one of the legs of the bracket 54. The bracket 54 further comprises a body portion 56 and a second leg 58 having an aperture 60 formed therein.

Inflation needle 50 carried by inflation hose 52 is inserted through a central hole formed in the grommet 70 and into the inflation aperture 17. Conventional connectors hold the needle 50 and hose 52 together. Collars 66 and 68, which can be formed of aluminum or the like, hold the bracket 54 and the hose 52 together in proper relation when the needle 50 is positioned to be received into the insertion aperture 17 with the collar 66 flushly contacting the underside of the plate 58 and the collar 68 contacting the upper side of the plate 58. The collar 66 is seen to be held in place by means of a set screw 65 and the collar 68 can be similarly held in place. The connection between the hose 52, the bracket 54 and the grommet 70 maintains the needle 50 in place in the aperture 17 during handling and inflation procedures. During the time that the inflatable device of the invention is lowered into a borehole (not shown) or the like and positioned therein for inflation, the adapter arrangement prevents slippage of the inflatable device from the needle 50. Once the inflatable device is fully inflated, the hose 52 can be pulled on with the effect that the bracket 54 pulls free of the grommet 70 even as the needle 50 pulls free from the insertion aperture 17. Formation of the grommet 70 of rubber or a similar material allows deformation of the grommet to allow the bracket 54 to pull free of the grommet. The inflation needle 50, the bracket 54 and the inflation hose 52 are thus removed from engagement with the inflatable device and the device is thus left in a borehole. The needle 50, the bracket 54 and the inflation hose 52 are then attached to another inflating device for positioning in the same or another borehole.

While the invention has been described relative to particular embodiments, it is to be understood that the invention can be practiced other than as explicitly described herein, the invention being limited only by the recitation of the appended claims.

What is claimed is:

1. A device capable of being inflated in a borehole formed in the earth prior to initiation of blasting operations within the borehole, the device being used to suspend or hold a body of stemming material or explosive material within the borehole comprising, a first body member formed of a resilient material;

a second body member formed of a resilient material and contained within the first body member;

a reinforcing scrim provided between inner wall surfaces of the first body member and outer wall surfaces of the second body member, the scrim being held between said surfaces and being contiguous thereto to resist forces acting on the device during inflation thereof and during maintenance of said body of stemming material or explosive material within said borehole; and means carried by the device for inflating the second body member and thus the device.

2. The device of claim 1 wherein the first body member comprises a playground ball.

3. The device of claim 2 wherein the first body member and the second body member are substantially spherical and are congruent.

4. The device of claim 3 wherein the reinforcing scrim is formed of a pattern of randomly-oriented, nonwoven filamentary material of substantially anisotropic character.

5. The device of claim 3 wherein the reinforcing scrim is formed of a pattern of randomly-oriented, nonwoven filamentary material having high tensile strength.

6. The device of claim 1 wherein the scrim is not adhered to wall surfaces of the members.

7. The device of claim 1 wherein the scrim is formed of filaments arranged at particular angles and spacings relative to adjacent filaments.

8. The device of claim 1 wherein the scrim is formed of woven filaments.

9. The device of claim 1 wherein the body members are formed of natural or synthetic elastomeric material formulations.

10. The device of claim 1 wherein the body members are formed of stretchable materials and the scrim is formed of a relatively non-stretchable material.

11. The device of claim 1 and further comprising means mounted to the first body member for increasing frictional engagement between the device and structure intended to lower the device into a borehole.

* * * * *